US005458412A

United States Patent [19]

Lee et al.

[11] Patent Number: 5,458,412

[45] Date of Patent: Oct. 17, 1995

[54] DOOR OPENING/CLOSING APPARATUS FOR A REFRIGERATOR

[75] Inventors: Sun G. Lee; Jae H. Lim, both of Suwon, Rep. of Korea

[73] Assignee: Samsung Electronics Co., Ltd., Suwon, Rep. of Korea

[21] Appl. No.: 141,607

[22] Filed: Oct. 27, 1993

[30] Foreign Application Priority Data

Oct. 31, 1992 [KR] Rep. of Korea ..... 1992-20383
Nov. 7, 1992 [KR] Rep. of Korea ..... 1992-21831

[51] Int. Cl.[6] ..... A47B 88/00

[52] U.S. Cl. ..... 312/309; 312/319.2; 49/260

[58] Field of Search ..... 312/311, 309, 312/319.2, 359.1; 49/260; 126/191, 194

[56] References Cited

U.S. PATENT DOCUMENTS 5,275,456 1/1994 Ishii et al. ..... 312/319.2

FOREIGN PATENT DOCUMENTS 2614251 10/1977 Germany ..... 312/319.1

*Primary Examiner*—Kenneth J. Dorner
*Assistant Examiner*—Gerald A. Anderson
*Attorney, Agent, or Firm*—Burns, Doane, Swecker & Mathis

[57] ABSTRACT

A refrigerator includes a storage compartment having a door at its front end which is hinged to swing about a horizontal pivot axis disposed along a lower edge of the door. The hinge is mounted on a slidable member for forward and rearward sliding movement. The door is connected to the refrigerator body by a pivoted arm arrangement which is connected to the slidable member to cause the hinge to be slid forwardly when the door is opened, and to be slid rearwardly when the door is closed. The slidable member can be connected to a slidable food-supporting tray to cause the tray to slide along with the slidable member.

11 Claims, 8 Drawing Sheets

DOOR OPENING/CLOSING APPARATUS FOR A REFRIGERATOR

BACKGROUND OF THE INVENTION

This invention relates to a refrigerator door opening/closing apparatus which is adapted to facilitate the easy handling of relatively heavy food containers.

The refrigerator, used to store various kinds of foodstuffs in either a cooled or frozen state to preserve the food's freshness for an extended period of time, generally cools the stored foodstuffs either by utilizing the direct cooling method in which an evaporator for cooling air is installed in each separate cold storage compartment, or by utilizing the indirect cooling method in which an evaporator is installed in the main air passage located away from the cold storage compartments and air in the interior of the refrigerator is circulated through the evaporator by a fan.

Such a refrigerator generally has a freezing compartment and a cooling compartment which are separated from each other by an intermediate wall, and the cooling compartment is divided among several separate compartments which are kept at different temperatures in order to suitably store various types of foodstuffs.

Such a refrigerator also has front access doors which are vertically hinged so that they can be opened from the side opposite from the hinges.

However, such a two-door type refrigerator does not satisfy the user's needs according to a variety of foodstuffs each of which requires different ideal storage requirements.

Therefore, in order to accommodate various kinds of foods which need to be separately stored at each optimum storage temperature, a refrigerator with enlarged storage areas and with several separate compartments each equipped with its own door, has been produced.

Common methods for opening and closing the doors of the refrigerator are as follows: the type which is hinged on one vertical side of the compartment to be opened from the side opposite the hinges, the type which is hinged on the front surface of the bottom of the compartment so that it is opened from the top and then swings out, and the sliding type which can be extended and retracted.

A conventional type door which is hinged on one vertical side of the compartment to be opened from the side opposite the hinges is suitable for a cooling compartment having one large storage area to store various foodstuffs.

But, such a door is not suitable for a relatively small space which is designed to store a special foodstuff at a temperature suited to the unique nature of the foodstuff.

This is because the horizontal dimension of a cooling compartment with a small volume is relatively longer than its vertical dimension and thus the radius of rotation for opening and closing the door is considerably larger compared with the door which is hinged on the horizontal, and it is thus inconvenient and inefficient.

Further, when a person removes or places a relatively heavy food container in the storage compartment with the vertically hinged door, both hands must be used.

Furthermore, it is possible for such a door to prematurely close while in use, and therefore the object to be stored must be handled carefully until it is completely placed in the refrigerator compartment, and when the heavy food container must be placed in the back of the compartment, it is possible that the door will interfere with the process.

Recently, the horizontally hinged door has been utilized for surmounting the above problems.

Generally, a horizontally hinged door is attached with fixed hinges. Accordingly, the space between the compartment equipped with the horizontally hinged door and the next lower compartment must be greater than the thickness of the door because the horizontally hinged door must be free to open downward, and consequently, it detracts from the symmetry front view of the refrigerator, and the overall height of the refrigerator must be increased.

Further, the top surface of the opened door will be positioned higher than the floor of the storage compartment so that it interferes with the movement of foodstuffs, thereby causing an inconvenience when the foodstuffs are moved.

An object of the present invention is to solve the above problems by providing a door opening/closing apparatus for a horizontally hinged door which can be easily operated.

Another object of the present invention is to provide a door opening/closing apparatus which operates a door with the movement of a hinge for supporting and rotating the door, thereby allowing the space between the compartment and the lower compartment to be decreased.

Still another object of the present invention is to provide a door opening/closing apparatus whereby the door in the completely opened state and the floor surface of the storage compartment are configured to form the same horizontal plane, thereby allowing the stored foodstuffs to be easily stored or removed.

SUMMARY OF THE INVENTION

A door opening/closing apparatus for a refrigerator according to the present invention is installed at each side of the front of a storage compartment, and therefore only one door opening/closing apparatus will be described.

The door opening/closing apparatus of the present invention which opens and closes a door by pivoting in an up-down direction centered along the lower part of the door comprises a sliding member which is installed on the inner side wall of a storage compartment and is connected to the interior lower surface of the door by a hinge; a pivot arm one end of which is attached to the side wall of the storage compartment by means of an anchor pin, and the other end of which is attached to the interior surface of the door by means of an anchor pin; and a fixed guide which is installed on the side wall of the storage compartment to provide guide spaces for the sliding member and the pivot arm to be able to extend and retract.

In addition, it further comprises a tray which is rested over the floor of the storage compartment and has a plurality of rollers on its underside so that it can freely slide in and out of the compartment.

The pivot arm includes a first arm section and a second arm section.

The first section is attached to the interior surface of the door by means of an anchor pin, and the second section is attached to the side wall of the storage compartment by means of an anchor pin. Therefore, the pivot arm moves in the extend-retract direction in such a manner that the first and second arm section fold or unfold in accordance with the opening and closing movements of the door.

The fixed guide furnishes guide spaces in which the pivot arm and the sliding member move and includes a vertical plate and a horizontal plate.

The sliding member includes a horizontal element which is located at the space formed between the horizontal plate of the fixed guide and the floor of the storage compartment and is connected to the interior lower surface of the door by means of a hinge, and a vertical element which is located at the front of the wall surface of the vertical plate of the fixed guide and is connected to the pivot arm located at the rear of the wall surface of the vertical plate, and it extends and retracts with the movement of the door and the pivot arm.

The front floor surface of the storage compartment, on which the horizontal element of the sliding member is located, is designed to be slightly lower than the height of the rear floor surface of the storage compartment, so that the top surface of the horizontal plate of the fixed guide and the rear floor of the storage compartment form a truly horizontal plane, and a space is formed between the horizontal plate and the front floor of the storage compartment.

The horizontal element of the sliding member is positioned at the space formed between the horizontal plate and the front floor of the storage compartment and moves in the extend-retract direction, and thus the hinge connecting the door with the horizontal element of the sliding member moves in the extend-retract direction with the movement of the door.

The tray is placed on the horizontal surface formed by both the horizontal plate of the fixed guide and the rear floor of the storage compartment, and extends or retracts into the storage compartment by means of the rollers mounted on the underside of the tray in order to easily access foodstuffs stored or to be stored.

A guide pin is mounted on the second arm of the pivot arm attached to the side wall of the storage compartment, and a vertical guide slot is formed in the vertical element of the sliding member, and a horizontally curved guide track is formed in the vertical plate of the fixed guide.

The guide pin is inserted into both the guide slot and the guide track so that the sliding member and the pivot arm move simultaneously.

Accordingly, in order to open or close the door the horizontal element of the sliding member connected to the door by means of the hinge is extended and retracted, and at the same time, the guide pin, which is inserted into both the guide slot and the guide track, is moved forward and backward along the guide track with the movement of the pivot arm, so that the door is opened or closed by the interconnected movement of the pivot arm and the sliding member.

Besides, an elastic member is installed between the guide pin and the horizontal plate of the fixed guide in order for the door to be elastically opened and closed.

The upper surface of the door in the opened state and the tray are designed to be on the same horizontal plane so that when the door is completely opened, a heavy food container on the tray is able to be moved over the tops of the tray and the door without any interference from the door.

Further, a curved projection is formed on the second section of the pivot arm, and a cylindrical stopper is mounted on the vertical plate of the fixed guide, so that when the pivot arm moves forward, the projection is pressed by the stopper and the further opening of the door is prevented.

The movement of the door opening/closing apparatus configured as described above will be described below.

When the user pulls a handle which is mounted on the upper part of the closed door, the pivot arm, which has been retracted into the space formed between the vertical plate of the fixed guide and the side wall of the storage compartment, is unfolded and extends forward.

At the same time, the sliding member moves forward as the guide pin located in the guide slot in the vertical element of the sliding member moves forward along the curved guide track formed in the vertical plate of the fixed guide.

The horizontal element of the sliding member, which is connected to the interior lower surface of the door by means of the hinge, also move forward with the above movements.

Therefore, because the door is opened by the moved hinge member, the space between the described storage compartment door and the next-lower compartment door can be decreased.

The opening movement of the door is completed when the extension of the pivot arm is limited by the stopper of the fixed guide.

When the door is open, the inner surface of the door and the top surface of the tray form one level horizontal plane.

Further, if the user pulls the tray out, the tray moves forward near to the front edge of the door as the rollers rotate on the floor of the storage compartment and the horizontal plate of the fixed guide, so that a heavy food container can be easily handled.

Furthermore, the movement of the tray can be automatically achieved. That is, a tab is formed on the vertical element of the sliding member, and a notch is cut into the side of the tray in order to receive the tab, and thus the tray is automatically extended or retracted with the movement of the sliding member.

If the user raises the opened door to return it to the closed position, each member is moved in the reverse direction from the above-described movements to open the door.

As described above, the door opening/closing apparatus for a refrigerator according to the present invention provides the benefit that a refrigerator door operated by this invention can be opened and closed easily and promptly because the door opens and closes in an up-down direction rotating around the lower part of the door, and the overall height of the refrigerator can be decreased and the front view symmetry of the refrigerator is improved because the space between the compartment having the door opening/closing apparatus and the lower compartment can be decreased.

Further, this invention has another benefit in that the inserting and removing of foodstuffs can be easily achieved because when the door is open, the top surfaces of the tray and the door form one level horizontal plane.

Especially, it is very convenient to insert or remove heavy food containers in and out of the refrigerator by utilizing this invention.

DESCRIPTION OF THE PREFERRED EMBODIMENTS

Figure 1:
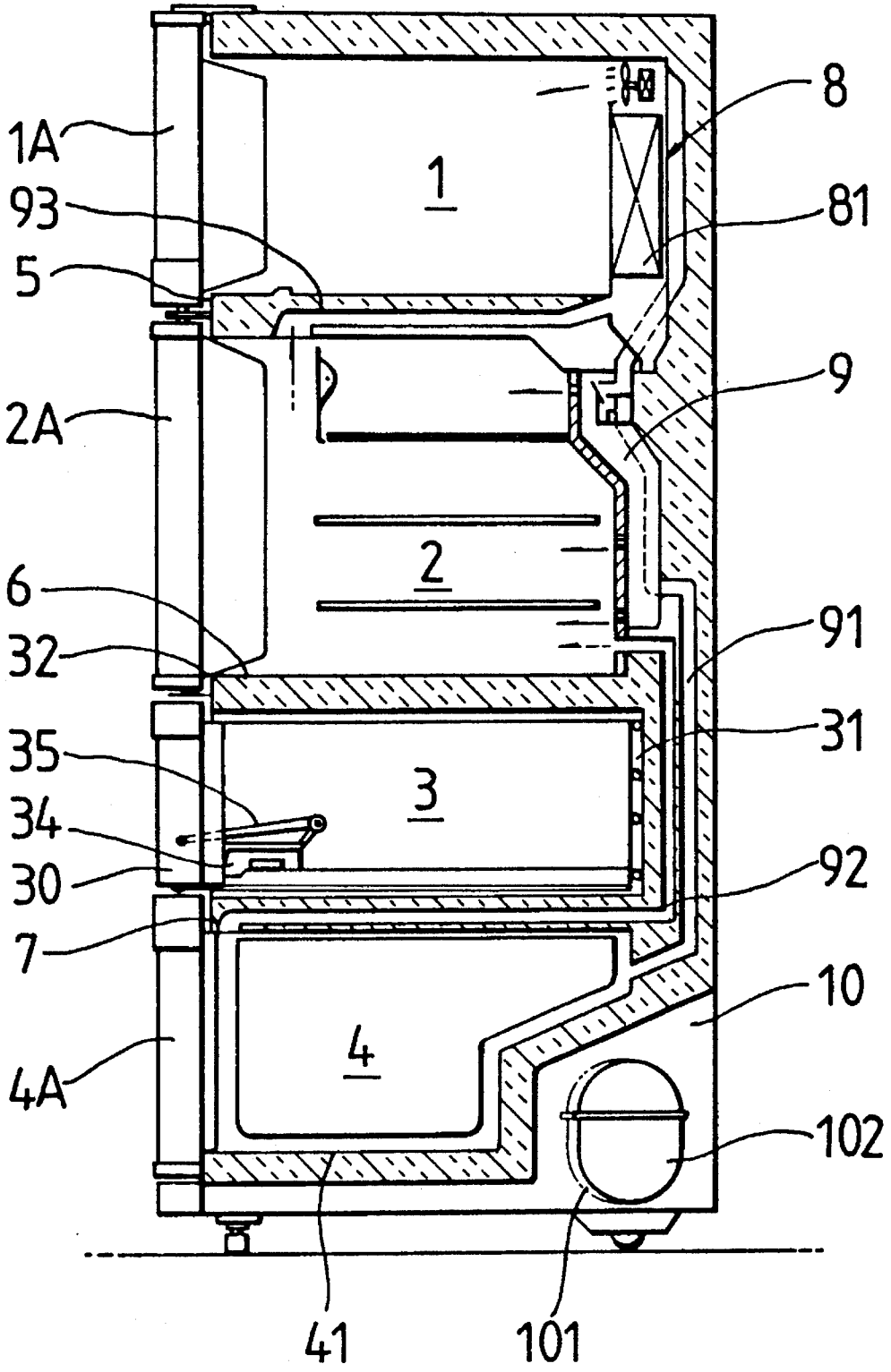
FIG. 1 is a longitudinal sectional view of a refrigerator where the door opening/closing apparatus of this invention is installed.

As illustrated in FIG. 1, the refrigerator on which a door operated by the present invention is mounted has a freezing compartment 1, a cooling compartment 2, a storage compartment 3, and a vegetables compartment 4.

The freezing compartment 1 and the cooling compartment 2 are opened and closed by doors 1A and 2A respectively, each rotating on vertical hinges and opening from the side opposite the hinges. The storage compartment 3 is opened and closed by a door 30 which moves in an up-down direction about a horizontal pivot axis disposed at the lower part of the door 30 by utilizing the present invention, and the vegetables compartment 4 is opened and closed by a door 4A which slides together with vegetables box 41 therein.

A first, a second, and a third intermediate wall 5, 6, and 7 which are composed of thermal insulating materials are placed between each compartment 1, 2, 3, and 4.

An evaporator 81 is installed in the back wall of the freezing compartment 1, and area 8 in which the evaporator 81 is placed is connected with the main air passage 9 for circulating cooled air into the cooling compartment 2 and the vegetables compartment 4.

Further, there is a machine compartment 10 located under the vegetables compartment 4, which contains a compressor 101 therein.

In the refrigerator configured as above, a door opening/closing apparatus of this invention is mounted on the storage compartment 3 which contains an evaporator 31 for performing a low-temperature storage function at its back wall and has the front door 30 which is opened and closed according to this invention.

A door opening/closing apparatus of this invention is mounted at each side of the front of the storage compartment 3.

For convenience, a first embodiment door opening/closing apparatus which is mounted on one side of the storage compartment 3 will be described.

Figure 2:
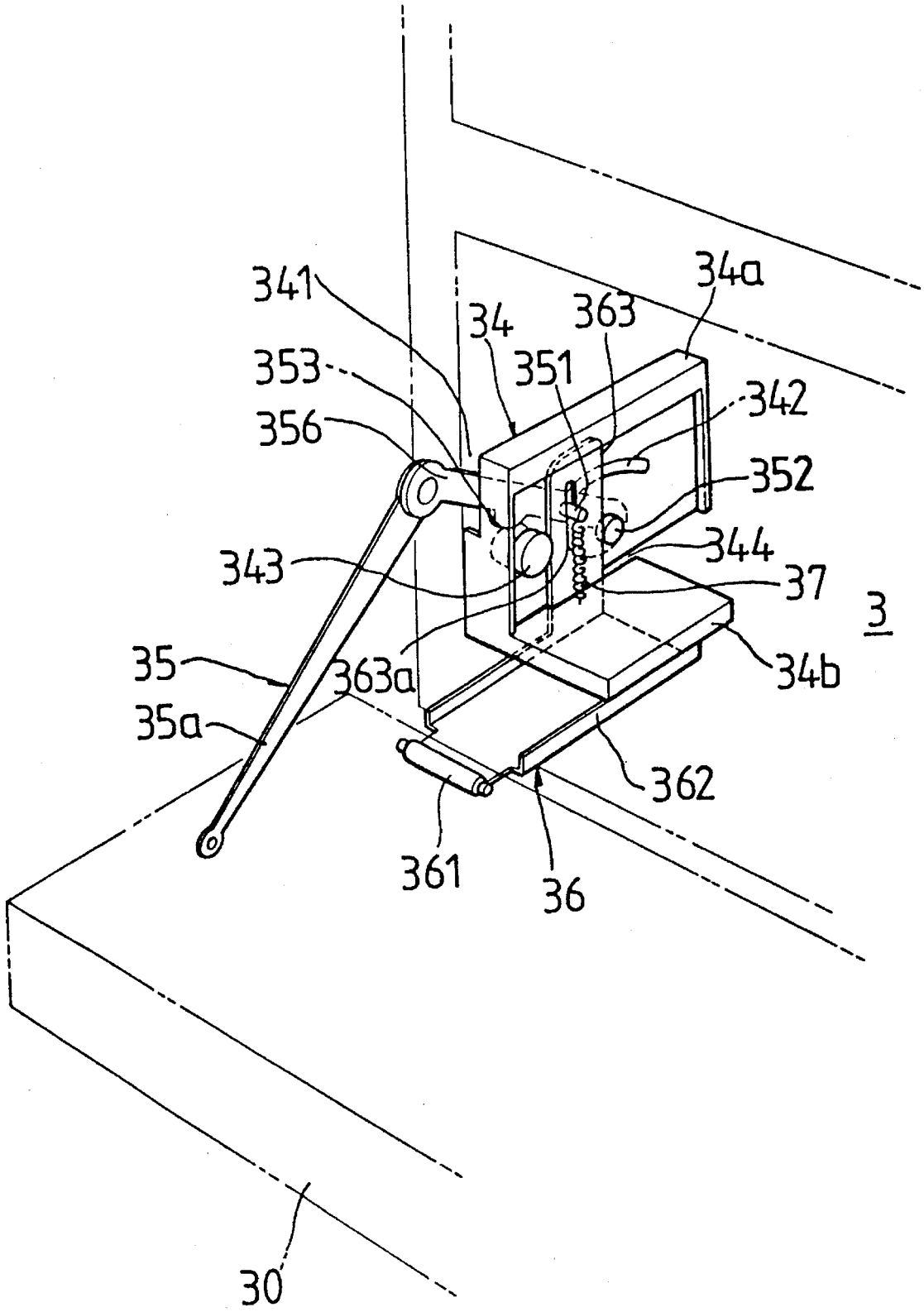
FIG. 2 is a perspective view of the present invention.
Figure 3:
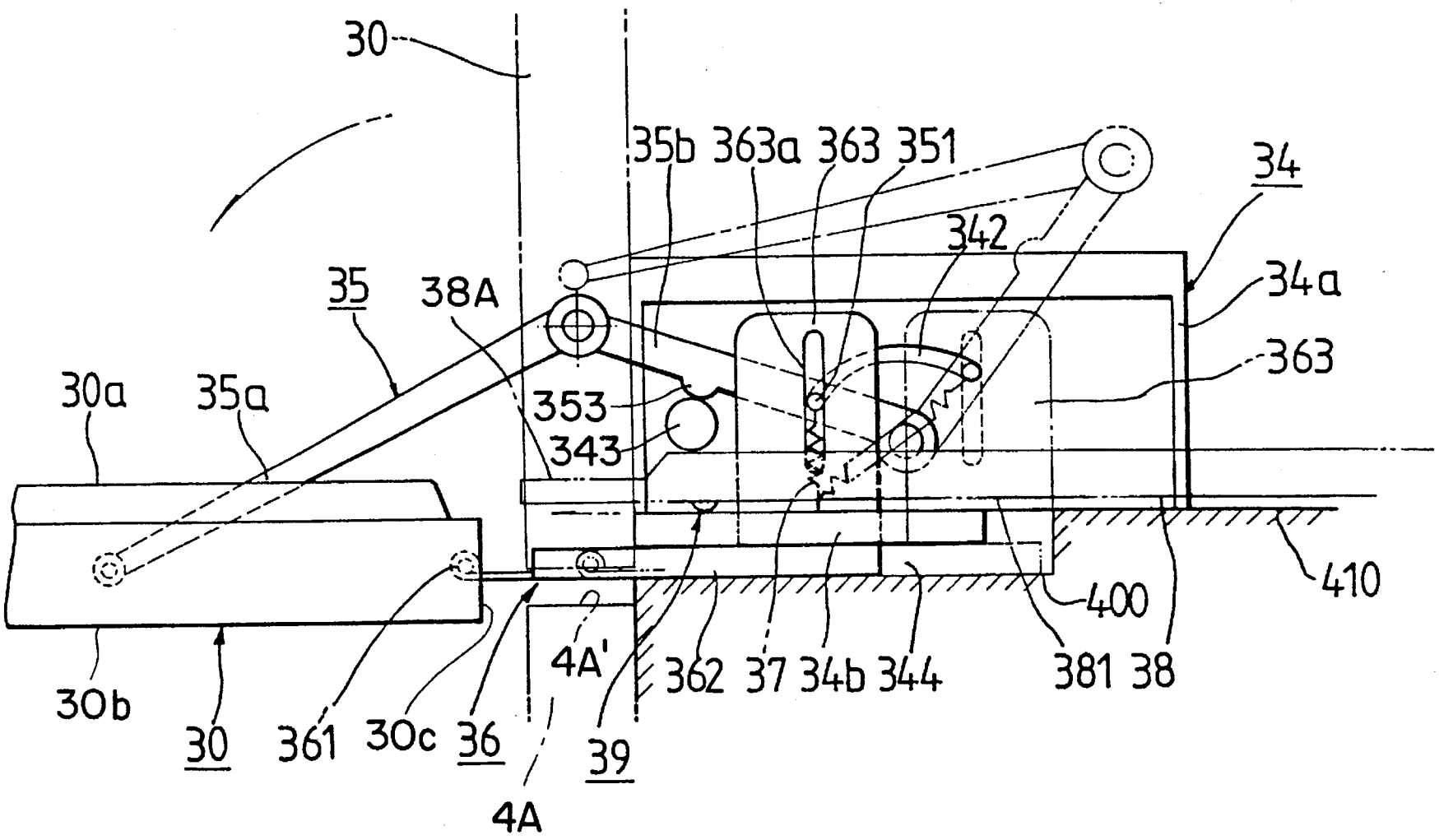
FIG. 3 is a side view illustrating a door operated by the door opening/closing apparatus of this invention when it is converted from the closed state to the opened state.
Figure 4:
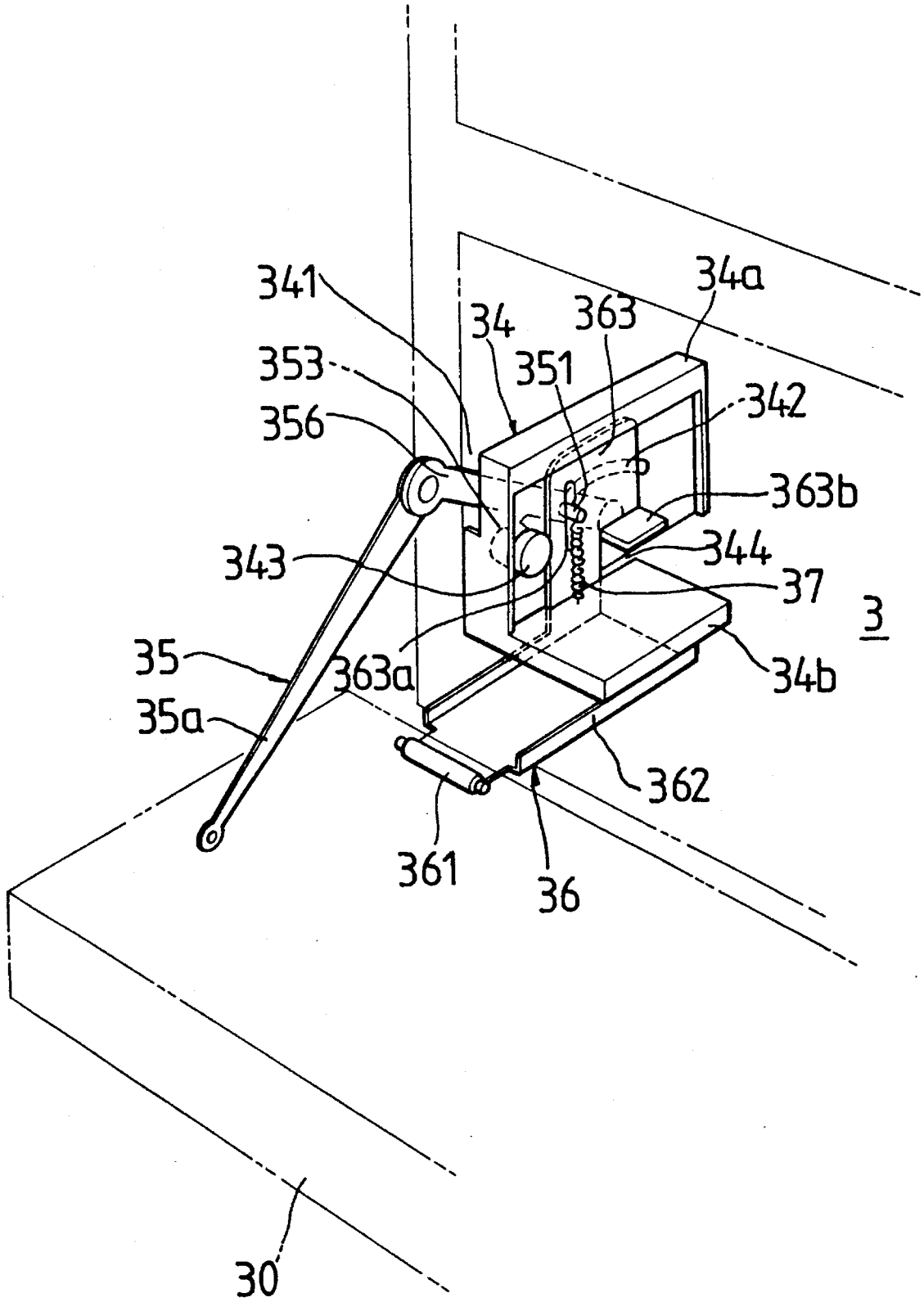
FIG. 4 is a perspective view illustrating a second preferred embodiment which is constructed to automatically extend and retract a tray placed on the floor of the storage compartment.
Figure 5:
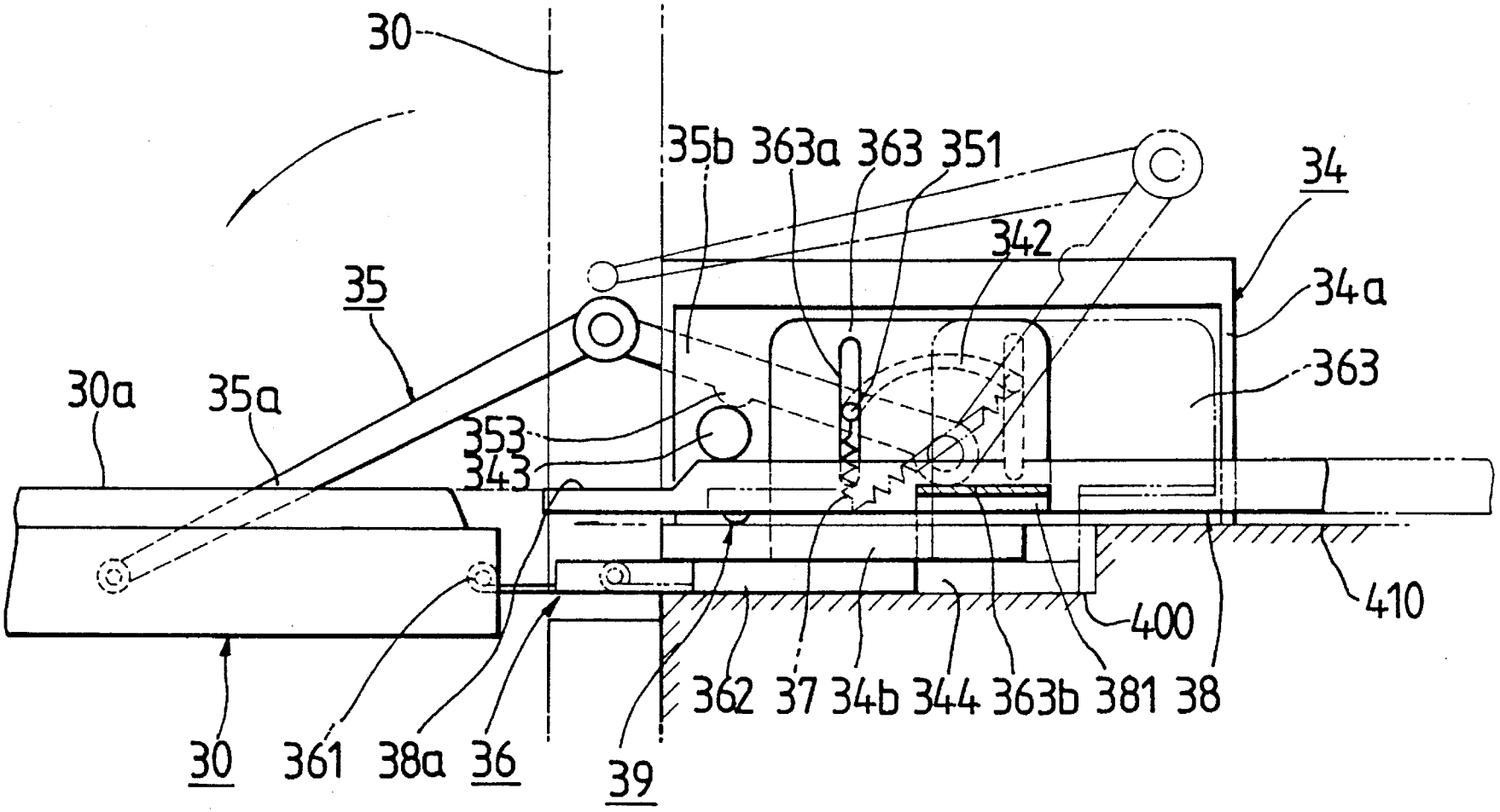
FIG. 5 is a side view of FIG. 4.
Figure 6:
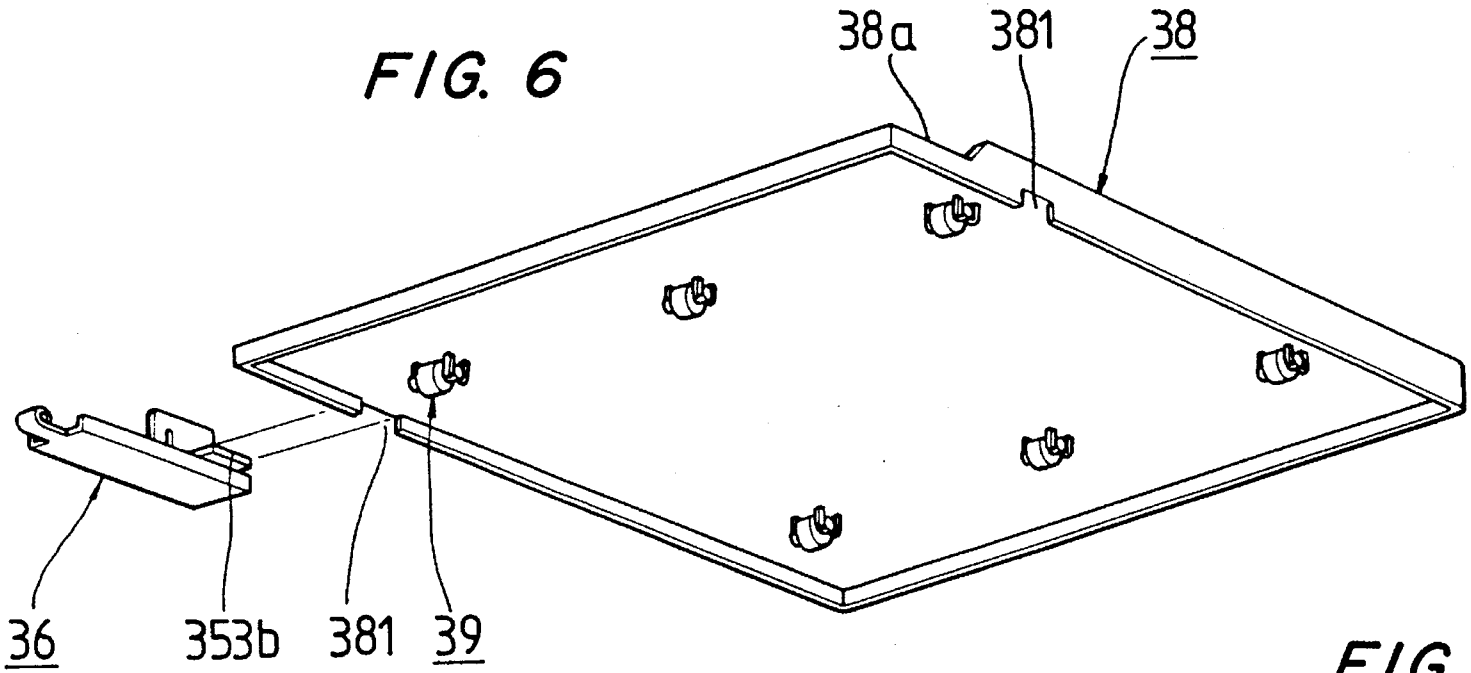
FIG. 6 is a perspective view illustrating the under side of the tray.
Figure 7:
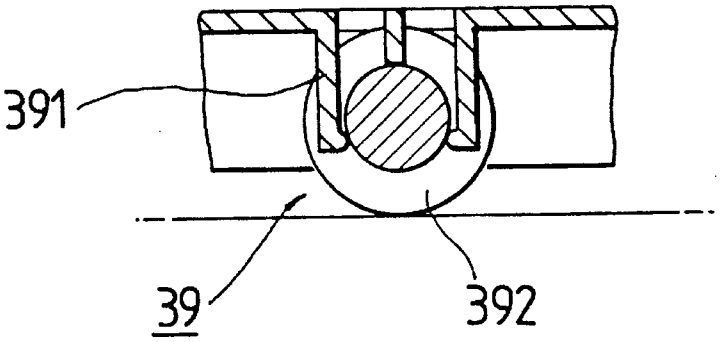
FIG. 7 is a side view of a roller shown in FIG. 6.

As shown in FIGS. 2 and 3, the present invention comprises a fixed guide 34, a pivot arm 35, a sliding member 36, and a tray 38.

The fixed guide 34 includes a vertical plate 34*a* which is mounted to the inside wall of the storage compartment 3, and a horizontal plate 34*b* which is placed above front floor 400 of the storage compartment 3 and lies or the same horizontal level with rear floor 410 of the storage compartment 3 (see FIG. 3).

The floor of the storage compartment 3 is stepped so that the height of the front floor 400 is lower than that of the rear floor 410, which provides space for movement of a horizontal element 362 of the sliding member 36 which will be described below.

The fixed guide 34 provides space 341 for moving the pivot arm 35 between the vertical plate 34*a* of the fixed guide 34 and the side wall of the storage compartment 3.

A curved guide track 342 for guiding the movement of the pivot arm 35 and the sliding member 36 is formed in the vertical plate 34*a* which is positioned parallel with the side wall of the storage compartment 3.

A cylindrical stopper 343 which projects through the wall of the vertical plate 34*a* is located at the front of the guide track 342 in order to prevent the further unfolding of the pivot arm 35.

The pivot arm 35 includes a first arm section 35*a* and a second arm section 35*b* which freely fold and unfold relative to each other.

The first arm section 35*a* is connected to the interior surface 30*a* of the door 30 by an anchor pin, and the second arm section 35*b* is connected to the side wall of the storage compartment 3 by an anchor pin 352.

Attached to the second arm section 35*b* is a guide pin or projection 351 which is inserted into both a vertical guide slot 363*a* formed in a vertical element 363 of the sliding member 36, and the guide track 342 and moves with the sliding member 36. A projection 353, which is prevented by the stopper 343 from further unfolding the pivot arm section 35, is formed on the second arm 35*b*.

The sliding member 36 includes the horizontal element 362 which is placed on the front floor 400 of the storage compartment 3, and the vertical element 363 which extends vertically from the inside edge of the horizontal element 362.

The front of the horizontal element 362 is connected to the bottom inside surface of the door 30 by a hinge 361 and is moved with the opening/closing movements of the door 30, and therefore the hinge 361 itself is moved when the door 30 is open or closed.

The guide slot 363*a* is vertically formed in the vertical element 363 as described above.

An elastic member 37 one end of which is connected to the horizontal plate 34*b* of the fixed guide 34 and the other end of which is connected to the guide pin 351, is provided in order to elastically open and close the door 30.

The tray 38, which is provided to carry food, rests over both the rear floor 410 of the storage compartment 3 and the horizontal plate 34*b* of the fixed guide 34. The tray possesses a plurality of rollers 39 on its underside which travel upon the horizontal plate 34*b* to facilitate forward and backward movement of the tray.

The installation of the present invention constructed as described above is performed as follows.

The horizontal element 362 of the sliding member 36 is positioned in the space formed between the horizontal plate 34*b* of the fixed guide 34 and the front floor 400 of the storage compartment 3, and connected to the interior lower surface of the door 30 by the hinge 361 attached to the front edge of the sliding member 36.

The vertical element 363 of the sliding member 36 is positioned at the front of the vertical plate 34*a* of the fixed guide 34, and connected to the pivot arm 35 in such a manner that the vertical guide slot 363*a* formed in the vertical element 363 receives the guide pin 351 attached to the second arm section 35*b* of the pivot arm 35.

The guide pin 351 is also inserted into the guide track 342 formed in the vertical plate 34*a* of the fixed guide 34.

The first arm section 35*a* of the pivot arm 35 is attached to the interior surface 30*a* of the door 30 by means of an anchor pin, and the second arm section 35*b* is attached to the side wall of the storage compartment 3 by means of the anchor pin 352, and it is also connected to the vertical element 363 of the sliding member 36 by the guide pin 351. That is, the door 30 is connected to the first arm section 35*a* of the pivot arm 35 and to the horizontal element 362 of the sliding member 36, and the pivot arm 35 is connected to the vertical element 363 of the sliding member 36, so that the door 30 is opened and closed by the movements of each of these members.

A door opening/closing apparatus as described above and mounted on each side of the storage compartment 3 to open and close the door 30. The operation will be described below.

FIG. 3 illustrates the door 30 as it is moved from the closed state to the opened state, in which the alternating long and two short dashes line shows the positions of each member when the door 30 is in the closed state.

In the closed state, if the user pulls the handle of the door 30 downward, the door 30 rotates in an outward and downward direction about an axis defined by the hinge member 361, and thus the first and second arms 35*a* and 35*b* of the pivot arm 35 are unfolded forward.

With the above movements, the guide pin 351 of the second arm section 35*b* is moved forward with the vertical element 363 of the sliding member 36 along the guide track 342 formed in the vertical plate 34*a* of the fixed guide At the same time, the horizontal element 362 of the sliding member 36 is also moved forward by the action of the guide pin 351 pushing against the vertical element 363.

When the forward movement of the projection 353 of the second arm section 35*b* is limited by the stopper 343 as the pivot arm 35 is pulled forward during the opening of the door 30, the door 30 is completely opened by having turned 90 degrees from the vertical closed state.

On the other hand, if the user pulls the tray 38 when the door 30 is in an opened state, the tray 38 can be extended from the storage compartment 3 by the rotation of the rollers 39 mounted on its underside.

Note that the outer wall surface 30*b* of the door 30 when in a horizontal opened condition is disposed at a lower elevation than an upper edge 4A' of the next lower door 4A which would not have been possible if the hinge 361 had not been displaced forwardly. Hence, the edge 4A can be disposed closer to the lower edge 30*c* of the door 30 when the latter is closed than would otherwise have been possible.

Since the top surface 38*a* of the tray 38, on which the stored foodstuffs are placed, is on the same horizontal plane as the inner wall surface 30*a* of the horizontal door 30 in the opened state, even a relatively heavy food container can be easily placed in or removed from the storage compartment 3 through the inner wall surface of the door 30 and the top surface 38*a* of the tray 38 without interference from the door 30.

Figure 8:
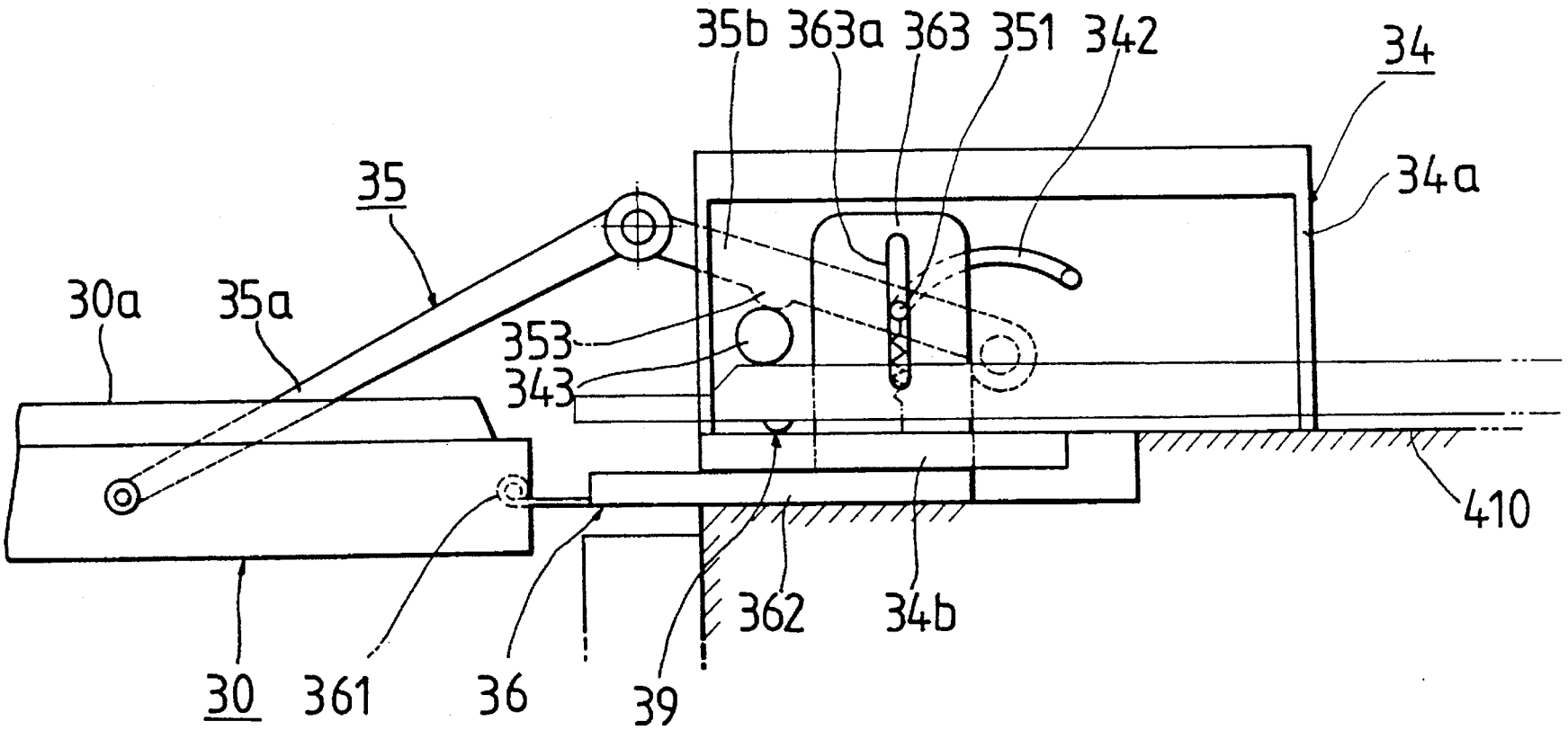
FIG. 8 is a side view of the present invention wherein the door is in the opened state.
Figure 9:
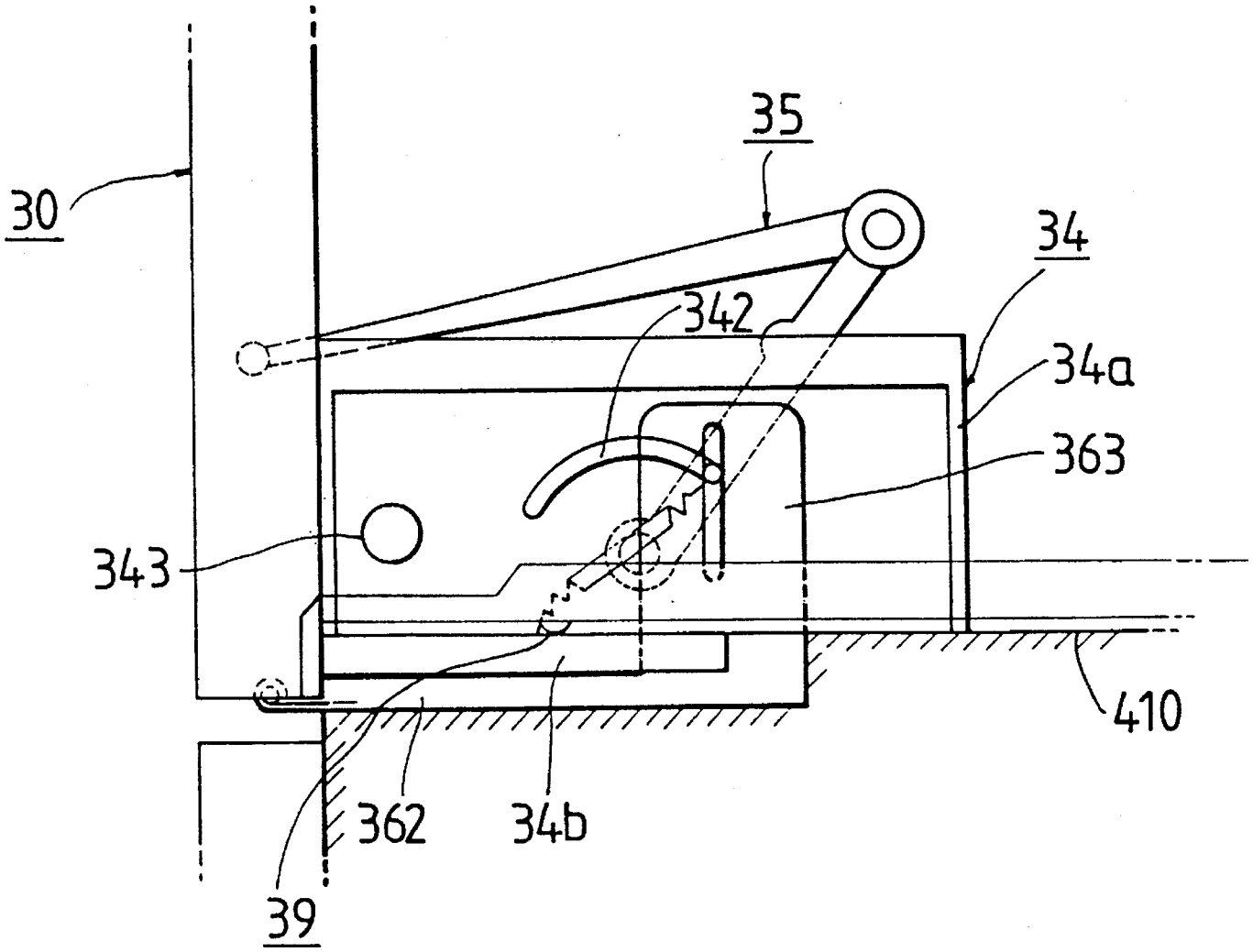
FIG. 9 is a side view of the present invention wherein the door is in the closed state.

When the door 30 in the opened state, as illustrated in FIG. 8, is changed to the door 30 in the closed state, as illustrated in FIG. 9, each member of the door opening/closing apparatuses is moved in the reverse direction from that described above.

As a second preferred embodiment of the present invention, each door opening/closing apparatus is equipped with a means for automatically moving the tray 38 with the opening and closing of the door 30, instead of the manual type movement described above.

This is achieved by using the following members; a tab 363*b* is provided at the rear of the vertical element 363 of each sliding member 36 vertically against the vertical element 363, and notch 381 for receiving the tab 363*b* is provided at each side of the tray 38, so that the sliding member 36 and the tray 38 are interconnected.

Therefore, when the sliding member 36 is extended or retracted in accordance with the movement of the door 30, the tab 363*b* moves the tray 38 in the corresponding direction.

What is claimed is:

1. A storage compartment comprising:

wall means defining a space having an access opening at a forward end thereof;

a displaceable member mounted in said space adjacent a forward end thereof for forward and rearward movement;

a door for opening and closing said access opening;

hinge means interconnecting said door and a forward end of said displaceable member and defining a first pivot axis for enabling said door to be swung open and closed; and actuating means for displacing said displaceable member and said pivot axis forwardly in response to a swinging of said door toward an open state, and for displacing said displaceable member and said pivot axis rearwardly in response to a swinging of said door toward a closed state;

said actuating means comprising first and second arm sections, one end of said first arm section being pivotably connected to said door to define a second pivot axis, one end of said second arm section being pivotably anchored within said space to define a third pivot axis, other ends of said first and second arm sections being pivotably connected to one another to define a fourth pivot axis, said second, third and fourth pivot axes extending parallel to said first pivot axis.

2. A storage compartment according to claim 1, wherein said second arm section is connected to said displaceable member for displacing the latter.

3. A storage compartment according to claim 2, wherein said displaceable member is slidable forwardly and rearwardly and includes a slot extending laterally relative to the direction of sliding movement, said connection between said second arm section and said displaceable member defined by a projection carried by said second arm section and disposed for movement within said slot.

4. A storage compartment according to claim 3 including a fixed member attached fixedly to said wall means, said fixed member including a curved slot extending generally in the direction of sliding movement of said displaceable member, said projection being disposed for movement within said curved slot.

5. A storage compartment according to claim 4, wherein said fixed member is spaced from a portion of said wall means to define therewith an area in which said second arm section moves.

6. A storage compartment according to claim 5, wherein said fixed member is spaced from another portion of said wall means to define therewith an area in which said displaceable member moves.

7. A storage compartment according to claim 1 including an item-supporting tray disposed in said space for forward and rearward movement therein, said tray being operably connected to said displaceable member for forward and rearward movement therewith.

8. A storage compartment according to claim 1, wherein said first pivot axis is horizontal and disposed at a lower portion of said door so that said door swings downwardly to its open state and forms an upwardly facing horizontal surface in said open state, a tray disposed for sliding movement in said space for supporting items, said tray including a horizontal support surface which is substantially coplanar with said horizontal surface of said door when said door is in said open state.

9. A storage compartment according to claim 1, wherein said first pivot axis extends horizontally.

10. A storage compartment according to claim 9, wherein said wall means includes a floor and side walls, said displaceable member being mounted on said floor, and said hinge means being mounted to a lower portion of said door.

11. A storage comprising:

a main compartment;

a first storage compartment disposed below said main compartment and including a first door at a forward end thereof;

a second storage compartment disposed above said first storage compartment and below said main compartment, and comprising:

a space defined by a floor and side walls, said space having an access opening at a forward end thereof, a slide disposed in a recessed portion of said floor for forward and rearward sliding movement, said slide including horizontally and vertically extending portions, a second door for opening and closing said space, a hinge interconnecting to a lower portion of said door and a forward end of said horizontal portion of said slide and defining a first horizontal pivot axis for said door, a first arm section having one end thereof pivotably connected to said door for defining a second horizontal pivot axis disposed parallel to said first pivot axis, and a second arm section having one end thereof anchored in said space by means defining a third horizontal pivot axis disposed parallel to said first pivot axis, another end of said second arm section being pivotably connected to another end of said first arm section to define a fourth horizontal pivot axis disposed parallel to said first pivot axis, said second arm section carrying a projection disposed for movement within an upright slot formed in said vertically extending portion of said slide for displacing said slide forwardly in response to a swinging of said door toward an open state, and for displacing said slide rearwardly in response to a swinging of said door toward a closed state.

* * * * *